US009546083B2

(12) United States Patent
Lorenz et al.

(10) Patent No.: US 9,546,083 B2
(45) Date of Patent: Jan. 17, 2017

(54) FILLING MACHINE

(75) Inventors: Jonathan Lorenz, Bad Kreuznach (DE); Andreas Fahldieck, Idar-Oberstein (DE)

(73) Assignee: KHS GmbH, Dortmund (DE)

( * ) Notice: Subject to any disclaimer, the term of this patent is extended or adjusted under 35 U.S.C. 154(b) by 291 days.

(21) Appl. No.: 14/363,906

(22) PCT Filed: Sep. 15, 2012

(86) PCT No.: PCT/EP2012/003865

§ 371 (c)(1),
(2), (4) Date: Jun. 9, 2014

(87) PCT Pub. No.: WO2013/083209

PCT Pub. Date: Jun. 13, 2013

(65) Prior Publication Data

US 2014/0332115 A1 Nov. 13, 2014

(30) Foreign Application Priority Data

Dec. 8, 2011 (DE) ..... 10 2011 120 425

(51) Int. Cl.
*B67C 3/28* (2006.01)
*B67C 3/00* (2006.01)
(Continued)

(52) U.S. Cl.
CPC ..... *B67C 3/287* (2013.01); *B67C 3/004* (2013.01); *B67C 3/202* (2013.01); *B67C 3/225* (2013.01)

(58) Field of Classification Search
CPC ..... B67C 3/225; B67C 3/287; B67C 3/202; B67C 3/004
(Continued)

(56) References Cited

U.S. PATENT DOCUMENTS 4,024,896 A * 5/1977 Ishioka ..... B67C 3/001 141/90
6,073,667 A * 6/2000 Graffin ..... B67C 3/202 141/372
(Continued)

FOREIGN PATENT DOCUMENTS

DE 102007014639 9/2008
EP 1512663 3/2005
(Continued)

OTHER PUBLICATIONS

Japanese to English Machine Translation of JP2001031193.*

*Primary Examiner* — Mark A Laurenzi
*Assistant Examiner* — Timothy P Kelly
(74) *Attorney, Agent, or Firm* — Occhiuti & Rohlicek LLP

(57) ABSTRACT

An apparatus for filling containers with a filling material includes a transport element that rotates in a transport direction, filling positions formed on the transport element, and a common carrier common to all positions and moving with the transport element. Each filling position has a filling element, a weighing cell secured to the carrier, a container carrier, and a functional element assigned to the filling position on the common carrier. The common carrier is adjustable to move by an adjustment unit either in or opposite to the transport direction. The adjustment unit corresponds to a distance between functional elements of filler positions that are adjacent to each other in the transport direction.

17 Claims, 4 Drawing Sheets

(51) Int. Cl.
*B67C 3/20* (2006.01)
*B67C 3/22* (2006.01)

(58) Field of Classification Search
USPC ..... 141/83, 86–91, 144–152
See application file for complete search history.

(56) References Cited

U.S. PATENT DOCUMENTS 6,399,901 B1 * 6/2002 Nishino ..... B65B 3/28
141/372
7,104,033 B2 * 9/2006 Krulitsch ..... B67C 3/004
141/91

FOREIGN PATENT DOCUMENTS

| | | |
|---|---|---|
| FR | 2770292 | 4/1999 |
| JP | 2001031193 | 2/2001 |
| WO | WO2006/077050 | 7/2006 |

* cited by examiner

FILLING MACHINE

RELATED APPLICATIONS

This application is the national stage entry under 35 USC 371 of PCT/EP2012/003865, filed Sep. 15, 2012 which claims the benefit of the priority date of German application DE 10 2011 120 425.7, filed Dec. 8, 2011, the contents of which are herein incorporated by reference.

FIELD OF INVENTION

The invention relates to container processing, and in particular, to the filling of containers.

BACKGROUND

A known filling machine is a rotary filling machine having filling positions on a rotor that can be driven to rotate around a vertical machine axis. The filling positions, which each have one filling element, process containers of various types and/or sizes and/or shapes and also participate in CIP cleaning and/or CIP disinfection. A plurality of different container carriers and also a rinsing cap are assigned to each filling element or each filling position. These are on a carrier ring arranged on the same axis as the machine axis. The carrier ring is on the rotor so that it rotates in the same direction as and synchronously with the rotor.

The carrier ring can be adjusted by turning or swiveling around the machine axis relative to the rotor so that, depending on the carrier ring adjustment, there can be a change at all the filling positions simultaneously from a first container carrier to a second container carrier or to a rinsing cap for the CIP cleaning and/or CIP disinfection.

These known filling machines are not suitable for a filling method in which the quantity of filling material to be introduced into the container is determined by means of its weight or by means of its mass.

SUMMARY

It is the task of the invention to disclose a filling machine that, with a high level of operating reliability and with a rapid and problem-free switchover from a filling operation to a CIP cleaning and/or CIP disinfection and/or with a rapid and problem-free change of format, allows a fill-quantity-controlled filling or introduction of filling material into containers with a high level of accuracy.

In one aspect, the invention features an apparatus for filling containers with a filling material. The apparatus includes a transport element that rotates in a transport direction, filling positions formed on the transport element, and a common carrier common to all positions and moving with the transport element. Each filling position has a filling element, a weighing cell secured to the carrier, a container carrier, and a functional element assigned to the filling position on the common carrier. The common carrier is adjustable to move by an adjustment unit either in or opposite to the transport direction. The adjustment unit corresponds to a distance between functional elements of filler positions that are adjacent to each other in the transport direction.

In another aspect, the invention features apparatus for filling containers with a filling material. Such an apparatus includes a circulating transport element that is configured to be driven to rotate about a vertical machine axis in a transport direction, a common carrier, and a plurality of filling positions formed on the transport element. Each filling position has a filling element for controlled dispensation of filling material into a container, a weighing cell secured to the common carrier for quantity-controlled filling of a container, and first and second functional elements, the first one being a container carrier, and the second being assigned to the filler position. The two functional elements are arranged on the common carrier, which is common to all the filling positions and moves in the transport direction synchronously with the transport element. The common carrier is adjustable to move by at least one adjustment unit in either the transport direction or opposite the transport direction. The adjustment unit corresponds to a distance between functional elements of filler positions that are adjacent to each other in said transport direction.

In some embodiments, the common carrier comprises a carrier ring.

In other embodiments, the transport element comprises rotor.

Embodiments also include those in which each filling position has at least two different container carriers, and either an independent weighing cell is assigned to each of the at least two different container carriers or a common weighing cell is assigned to the at least two container carriers.

In some embodiments, the container carrier is held on the common carrier by the weighing cell.

In other embodiments, the filling element has a dispensing opening, and the second functional element has a closing element for closing the filling element in an area around the dispensing opening. Examples of closing elements include a closing plate and a closing cap.

Among these embodiments are those in which the closing elements are provided on a level of the common carrier, and the weighing cells are provided underneath that level.

Also among the foregoing embodiments are those in which the common carrier is configured to move toward the filling element to close the filling element, those in which the filling element is configured to move toward the common carrier to close the filling element, and those in which the filling element is configured to move toward the common carrier and the common carrier is configured to move toward the filling element to close the filling element.

In yet other embodiments, the common carrier comprises a plurality of projections projecting in a direction perpendicular to the transport direction. In these embodiments, the closing element is formed on a projection from the plurality of projections and the container carrier is between two of these projections that are adjacent to each other in the transport direction.

Embodiments include those in which the common carrier includes a carrier ring having an upper carrier ring section and a lower carrier ring section. In these embodiments, the closing element is provided on the upper carrier ring section and the weighing cell is provided on the lower carrier ring section.

Additional embodiments include those in which the container carrier is formed to hold a container on a neck ring thereof, and those in which the container carrier is formed to hold a container on a mouth flange thereof.

As used herein, "fill-quantity-controlled filling" means that the weight, and therefore the mass, of the filling material supplied to the particular container is preferably constantly recorded by at least one sensor unit, such as a weighing cell, and that the filling process is controlled on the basis of a weight-dependent electrical sensor signal generated by the sensor unit.

As used herein, "format change" means a switchover of the filling machine from containers of one type and/or one size and/or one shape to containers of another type and/or another size and/or another shape.

As used herein, the expressions "basically" or "approximately" mean deviations from the exact value in each case by +/−10%, and preferably by +/−5% and/or deviations in the form of changes not significant for functioning.

Further developments, benefits and application possibilities of the invention arise also from the following description of examples of embodiments and from the figures. In this regard, all characteristics described and/or illustrated individually or in any combination are categorically the subject of the invention, regardless of their inclusion in the claims or reference to them. The content of the claims is also an integral part of the description.

BRIEF DESCRIPTION OF THE DRAWINGS

The invention is explained in more detail below by means of the figures, in which.

DETAILED DESCRIPTION

A filling machine 1 fills containers 2 such as bottles with a filling material, typically a liquid filling material, such as a drink.

Figure 1:
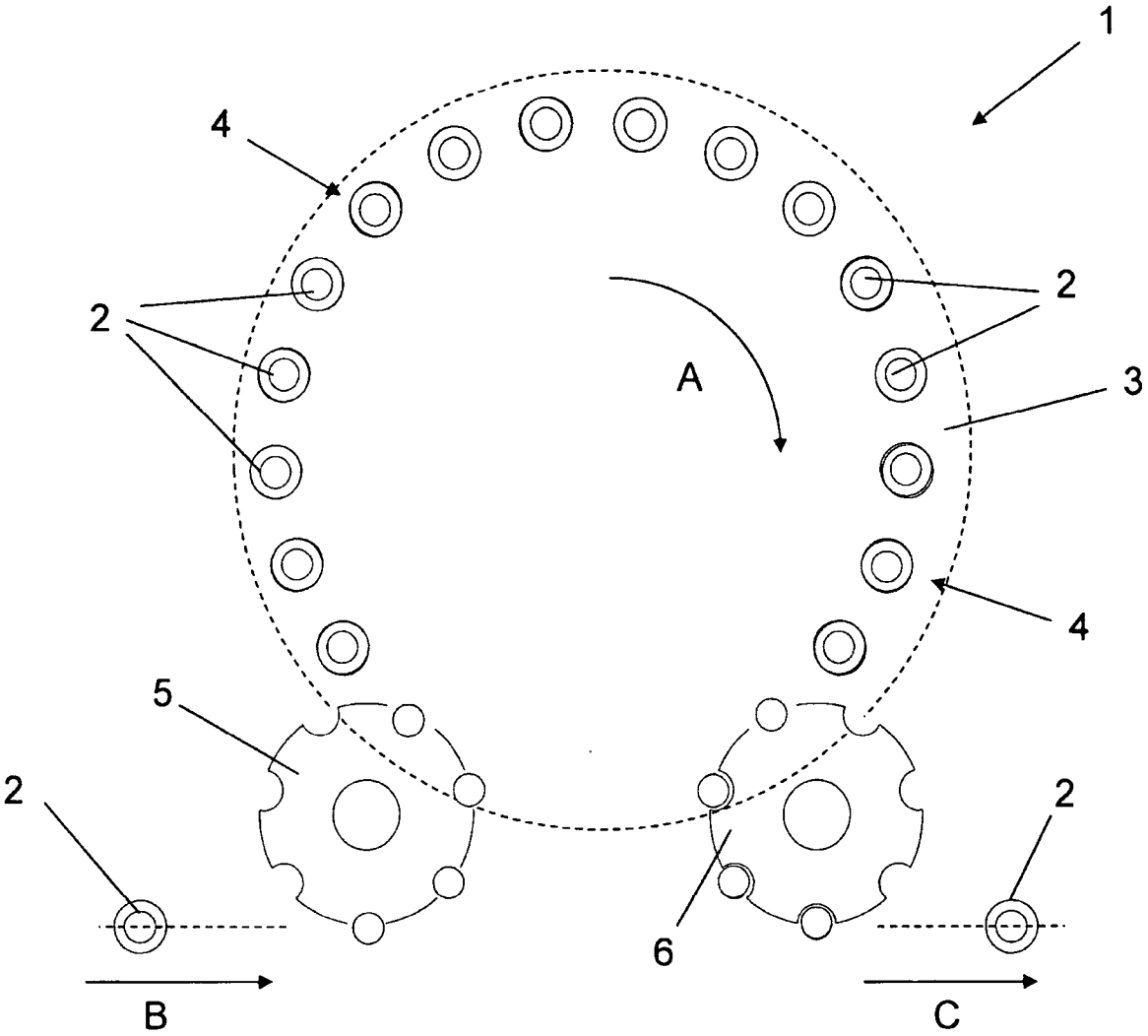
FIG. 1 is a simplified representation of a view from above of a filling machine of a rotating design for the filling of containers in the form of bottles with a liquid filling material.

As seen in FIG. 1, the filling machine 1 is a rotating filling machine having a rotor 3 that can be driven to rotate around a vertical machine axis MA. Filling positions 4 are provided on the circumference of the rotor 3 at regular angular distances and at the same radial distance from the machine axis A. The containers 2 to be filled are supplied to the rotor 3, and in particular to the filling positions 4, by an inlet start that passes containers into a container inlet 5. An outlet star 6 removes filled containers from the rotor 3, or from a particular filling position 4, at a container outlet 6.

Figure 2:
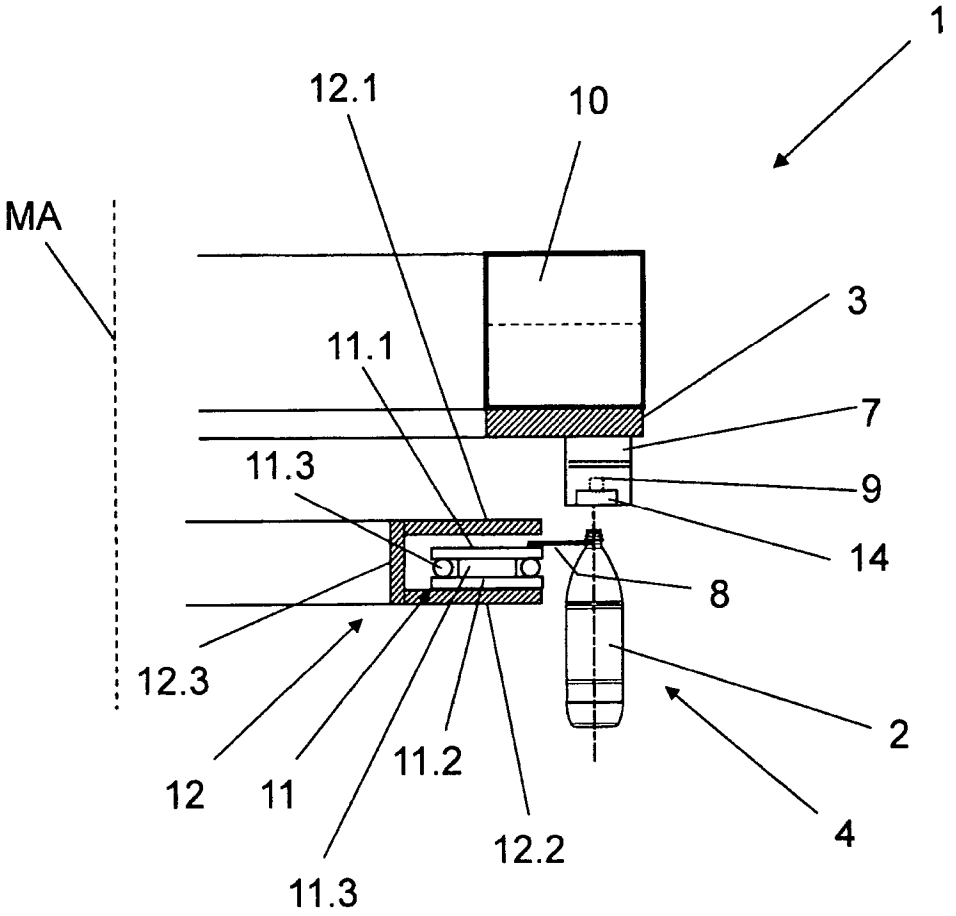
FIG. 2 is a simplified schematic representation of one of the filling positions of the filling machine in FIG. 1 together with a container arranged under the filling element for a free-jet filling.
Figure 3:
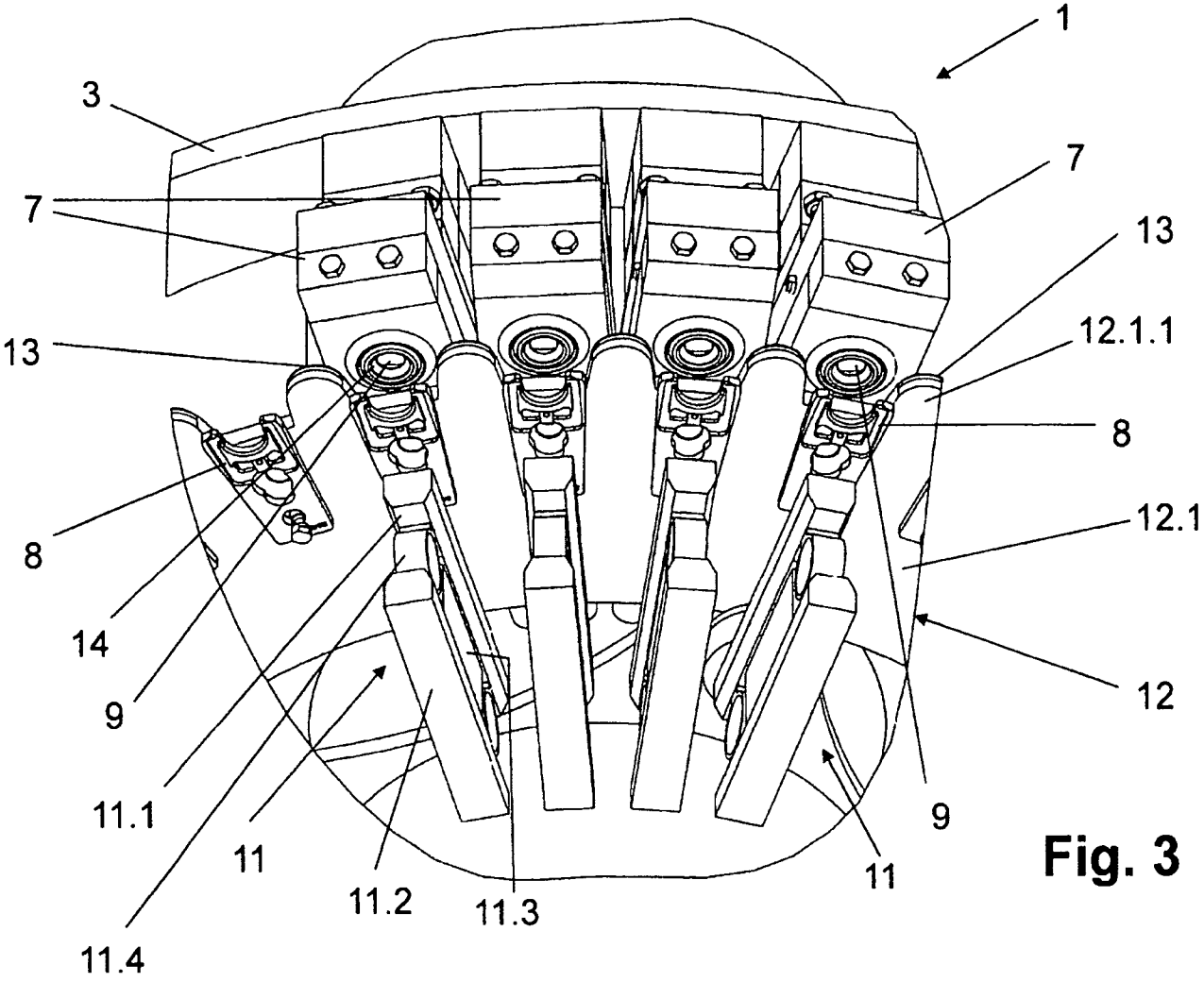
FIGS. 3 and 4 are perspective partial views, from below, of filling elements arranged on a rotor, together with container carriers provided on a carrier ring and closing elements in two operating states of the filling machine.

Referring to FIG. 2, a typical filling position 4 has a filling element 7 and a container carrier 8 on which a particular container 2 is held during filling. The container 2 is suspended from a container flange formed underneath the container opening directly underneath a dispensing opening 9 of the filling element 7 through which filling material flows into the container 2 during the filling process. The container carriers 8 are typically pincer-like and adapted to the neck ring diameter of the container 2. In the illustrated embodiment, during free-jet filling, there is a gap between the container's opening and the dispensing opening 7.

The filling elements 7 are all connected to an annular tank 10. During filling, the annular tank 10 is at least partially filled with the liquid filling material. This forms an upper gas space and a lower liquid space.

Each container carrier 8 has a sensor unit or weighing cell 11 that supplies a signal indicative of the mass of the container to a controller, such as a process computer of the filling machine 1. The process computer controls the filling element 7 assigned to the filling position 4. The filling of the containers 2 is thus controlled by the mass of the filling material introduced into the container 2.

In operation, the relevant filling element 7 opens when the filling position 4 reaches a specified angular position in the rotational movement of the rotor 3 after passing the container inlet 5. In problem-free operation, the filling element 7 closes when the necessary quantity of filling material has been introduced into the container 2. This is determined by recognizing when a container 2 has the necessary weight or, preferably, when the difference between the weight of the empty container 2 before the start of the filling process and the weight of the container 2 after the start of the filling process has reached a specified target value. The associated weighing cell 11 supplies, to the control computer, a signal indicating the attainment of this target filling material quantity.

The weighing cells 11, with their container carriers 8, are provided on a common carrier 12, which is in the form of a carrier ring 12. The carrier ring 12 is arranged with its ring axis on the same axis as the vertical machine axis MA. The rotor 3 connects to and drives the carrier ring 12 so that the two rotate synchronously and in the same direction.

A closing element 13 is provided on the circumference of the carrier ring 12 between any two container carriers 8 that would otherwise be adjacent to each other in a circumferential direction of the carrier ring 12. By using the closing element 13, it is possible to seal the dispensing opening 9 and a rinsing space 14 on the underside of the filling element 7 so that CIP ("clean-in-place") cleaning and/or CIP disinfection of the filling machine 1, and in particular, the product-transporting areas of the machine, can be carried out.

The carrier ring 12 can be adjusted by an angular value that corresponds to the spacing between the container carrier 8 assigned to a filling position 4 and the closing element 13 assigned to that filling position. This angular value corresponds to half the angular spacing between filling elements 7 on the circumference of the rotor 3.

During a filling operation, the closing element 13 is in its filling position. In this position, the container 2 can be under the filling element 7 so that the filling element 7 can fill the container 2.

Figure 4:
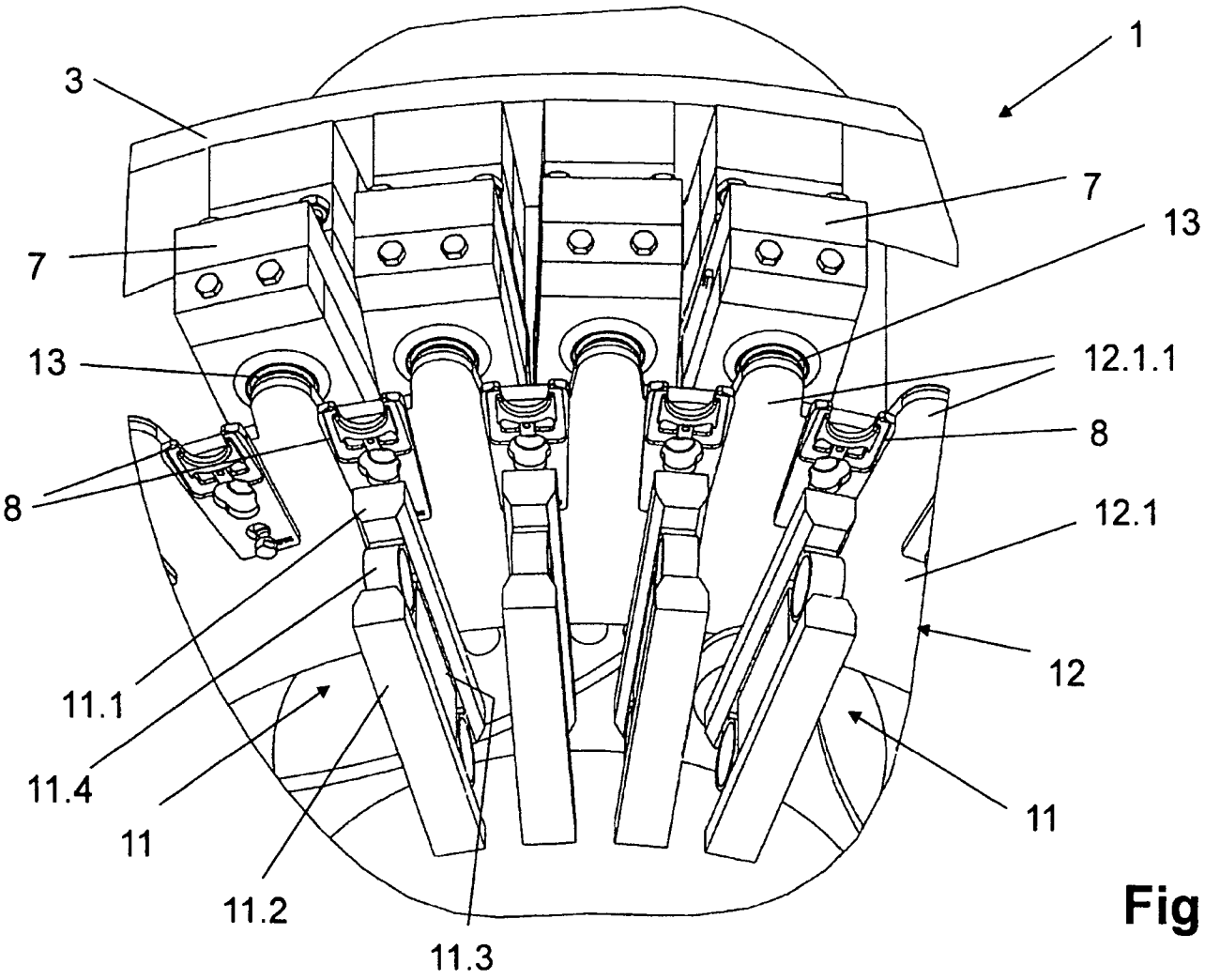

During a cleaning operation, the closing element 13 moves into its cleaning position, which is under the filling element 7. When in its cleaning position, the closing element 13 closes and seals the filling element 7 in the area of its dispensing opening 9 and rinsing space 14. To achieve this, the carrier ring 12, in the illustrated embodiment, can not only be rotated or swiveled around the machine axis MA, but can also be raised and lowered in the direction of the machine axis MA. When the carrier ring 12 is raised during the cleaning operation, the closing elements 13 lie pressed against the underside of the filling element 7, thus sealing the rinsing space 14, as shown in FIG. 4.

In the illustrated embodiment, a container carrier 8 and a closing element 13 are assigned to each filling element 7. Furthermore, the closing elements 13 are provided midway between two container carriers 8 one after the other in the circumferential direction of the carrier ring 12 so that the spacing between the container carrier 8 assigned to a filling position 4 and the closing element 13 assigned to that filling position 4 is equal to half the spacing of the filling elements 7 on the circumference of the rotor 3.

In the illustrated embodiment, the carrier ring 12 has an upper carrier ring section 12.1 and a lower carrier ring section 12.2. The upper and lower carrier ring sections 12.1, 12.2 are offset from each other in the direction of the machine axis MA. Both carrier ring sections 12.1, 12.2 extend along respective planes perpendicular to the machine axis MA and concentrically enclose this machine axis MA. A connecting carrier ring section 12.3 connects the two ring sections 12.1, 12.2 to each other. The carrier ring 12, with its upper, lower, and connecting carrier ring sections 12.1, 12.2, 12.3, is made in one piece. Finger-like projections 12.1.1 project from the outer circumference of the upper carrier ring section 12.1. These projections 12.1.1 are radially spaced in relation to the machine axis MA over its outer circumference. Other embodiments of the carrier ring 12 are also possible.

In the illustrated embodiment, the weighing cells 11 include an upper bar 11.1 and a lower bar 11.2 that have longitudinal extension oriented radially in relation to the machine axis MA. An elastic deformable body 11.3 connects the upper and lower bar 11.1, 11.2 to each other.

The container carrier 8 is fixed on the upper bar 11.1. The lower bar 11.2 is fastened on the upper side of the lower carrier ring section 12.2, facing the filling elements 7. Sensors 11.3, 11.4 detect a change in the position of the upper bar 11.1 relative to the lower bar 11.2. This change depends on the weight of the containers 2. The quantity of filling material introduced into the container 2 is recorded by processing the electrical measuring signals supplied by the sensors 11.3, 11.4.

In the illustrated embodiment, the closing elements 13 are formed as closing plates. On the upper side of the upper carrier ring section, facing the filling elements 7, finger-like projections 12.1.1 project from the upper carrier ring section 12.1. The closing elements 13 are formed by these projections.

The closing elements 13 are fitted in each case with a lining that acts as a seal. As a result, a closing element 13 lying pressed against a filling element 7 guarantees a seal in its rinsing space 14. Some filling elements 13 do not have a rinsing space 14 in the area of their dispensing openings 9. For these embodiments, the closing elements 13 can be made in a cap-like form.

As a result of the foregoing design, it is possible to move the closing elements 13 for all filling positions 4 jointly between the filling and cleaning positions.

The weighing cells 11 have a relatively large structural volume. This means that there is very little installation space remains to house the closing elements 13 once filling elements 7 are placed as close as possible to each other. In smaller filling machines, the reduced diameter of the rotor 3 further exacerbates this lack of space.

The configuration described herein makes optimal use of the limited space. In particular, arranging the closing elements 13 on the carrier or on the finger-like projections 12.1.1 and fixing the weighing cells 11 on the lower carrier ring section 12.2 or under the level of the closing elements 13 optimizes the use of the limited space for housing or mounting the closing elements 13.

Although they are mounted on the carrier ring 12 in a flexible and non-static manner, the weighing cells 11 achieve a surprisingly high measuring accuracy. This results in highly accurate filling of the containers 2. In fact, the accuracy is so high that it is also possible to make or use the filling machine 1 as a dosing filler. In a dosing filler, at least two different filling material components are introduced into the particular container 2 chronologically one after the other. The apparatus described herein is capable of using the measuring signals provided by the weighing cells 11 to precisely dose these components according to a specified formulation.

In the foregoing embodiment, each filling position 4 on the adjustable carrier ring 12 is assigned only one container carrier with a weighing cell 11, and one closing element 13.

In an alternative embodiment, at least one further functional element on the carrier ring 12 is assigned to each filling position 4. One such functional element is a further container carrier 8. A common weighing cell 11 or in each case an independent weighing cell 11 is provided for all container carriers 8 assigned to each filling position 4. The carriers are provided offset by one rotational stage of this ring from each other on the circumference of the carrier ring 12.

The container carriers 8 assigned to each filling position 4 are furthermore adapted to different container types and/or container sizes and/or to different neck ring diameters of the containers and/or to different types of mounting of containers, so that a problem-free and rapid format change is possible simultaneously for all the filling positions 4 by turning the carrier ring 12.

The invention has been described above using an example of an embodiment. It is clear that numerous modifications and variations are possible without thereby departing from the inventive idea underlying the invention.

Having described the invention, and a preferred embodiment thereof, what is claimed as new and secured by Letters Patent is:

The invention claimed is:

1. An apparatus for filling containers with a filling material, said apparatus comprising a circulating transport element, a common carrier, and a plurality of filling positions, each of said filling positions comprising a filling element, a weighing cell, a first functional element, and a second functional element, wherein said circulating transport element is configured to be driven to rotate about a vertical machine axis in a transport direction, wherein said filling positions are formed on said transport element, wherein said common carrier is common to all of said filling positions, wherein said filling element is configured for controlled dispensation of filling material into a container, wherein said first functional element comprises a container carrier, wherein said first functional element is arranged on said common carrier, wherein said second functional element is arranged on said common carrier, wherein said common carrier is moved in said transport direction synchronously with said transport element, wherein said common carrier is adjustable to move by at least one adjustment unit in a direction selected from the group consisting of said transport direction and a direction that is opposite to said transport direction, wherein said adjustment unit corresponds to a distance between functional elements of filler positions that are adjacent to each other in said transport direction, wherein said weighing cell is secured on said common carrier for quantity-controlled filling of said container wherein each filling position comprises at least two different container carriers, and wherein an assignment of said weighing cell to said at least two different container carriers is selected from the group consisting of a first assignment and a second assignment, wherein, in said first assignment, said weighing cell is an independent weighing cell assigned to each of said at least two different container carriers, and wherein, in said second assignment, said weighing cell is a common weighing cell assigned to said at least two container carriers.

2. The apparatus of claim 1, wherein said common carrier comprises a carrier ring.

3. The apparatus of claim 1, wherein said transport element comprises a rotor.

4. The apparatus of claim 1, said assignment is selected to be said first assignment.

5. The apparatus of claim 1, wherein said assignment is selected to be said second assignment.

6. The apparatus of claim 1, wherein said container carrier is held on said common carrier by said weighing cell.

7. The apparatus of claim 1, wherein said filling element comprises a dispensing opening, and wherein said second functional element comprises a closing element for closing said filling element in an area around said dispensing opening.

8. The apparatus of claim 7, wherein said closing element comprises a closing plate.

9. The apparatus of claim 7, wherein said closing element comprises a closing cap.

10. The apparatus of claim 7, wherein said closing elements are provided on a level of said common carrier, and wherein said weighing cells are provided underneath said level.

11. The apparatus of claim 7, wherein said common carrier is configured to move toward said filling element to close said filling element.

12. The apparatus of claim 7, wherein said filling element is configured to move toward said common carrier to close said filling element.

13. The apparatus of claim 7, wherein said filling element is configured to move toward said common carrier and said common carrier is configured to move toward said filling element to close said filling element.

14. The apparatus of claim 7, wherein said common carrier comprises a plurality of projections, wherein said projections project in a direction perpendicular to said transport direction, wherein said closing element is formed on a projection from said plurality of projections, wherein said container carrier is provided between two projections from said plurality of projections, and wherein said two projections are adjacent to each other in said transport direction.

15. The apparatus of claim 7, wherein said common carrier comprises a carrier ring having an upper carrier ring section and a lower carrier ring section, wherein said closing element is provided on said upper carrier ring section and said weighing cell is provided on said lower carrier ring section.

16. The apparatus of claim 1, wherein said container carrier is formed to hold a container on a neck ring thereof.

17. The apparatus of claim 1, wherein said container carrier is formed to hold a container on a mouth flange thereof.

* * * * *